United States Patent [19]

Stralow

[11] Patent Number: 4,720,234

[45] Date of Patent: Jan. 19, 1988

[54] BACKHOE

[76] Inventor: Cecil J. Stralow, 14672 Brookstone Dr., Poway, Calif. 92064

[21] Appl. No.: 887,811

[22] Filed: Jul. 21, 1986

[51] Int. Cl.[4] ..... E02F 3/32; E02F 3/627

[52] U.S. Cl. ..... 414/686; 414/692; 414/694; 172/272

[58] Field of Search ..... 414/686, 688, 692, 694, 414/695.5, 687, 680, 685; 172/272-275; 212/229

[56] References Cited

U.S. PATENT DOCUMENTS

| | | | |
|---|---|---|---|
| 3,282,452 | 11/1966 | Parsen | 414/694 |
| 3,376,984 | 4/1968 | Long et al. | 414/694 |
| 3,987,914 | 10/1976 | Van Der Zyl et al. | 414/694 |
| 4,074,821 | 2/1978 | Long | 414/694 |
| 4,278,394 | 7/1981 | Johnson | 414/694 |
| 4,358,240 | 11/1982 | Shumaker | 414/694 |

FOREIGN PATENT DOCUMENTS 1913581 9/1970 Fed. Rep. of Germany .

*Primary Examiner*—Robert J. Spar
*Assistant Examiner*—Jay I. Alexander

[57] ABSTRACT

The boom of a backhoe is hinged to one end of a two-position cradle-like tilt member. The base of a single control cylinder is hinged to the other end and the piston is pivotally secured to the boom to swing it so that boom and control cylinder do not mutually interfere but allow for more stable transport and deeper working range. The cradle is pivotally mounted near its center on a swing tower, adjustable in azimuth. The cradle is caused to move to its end positions by control of the boom and its load. Actuating means for the dipper arm of the backhoe is secured between arm and the boom. Suitable locks are provided for securing the cradle in the transport and working positions.

16 Claims, 11 Drawing Figures

BACKHOE

BACKGROUND OF THE INVENTION

This invention is concerned with the backhoe mechanism mounted on a tractor or similar vehicle intended for use as a power driven unit.

U.S. Pat. No. 3,376,984 to E. B. Long et al typifies the prior art backhoe arrangement. In the Long et al implementation upper and lower mounting brackets extend rearwardly from the tractor. A generally U-shaped swing tower is pivotally mounted to the brackets with the open end of the U-shape facing rearward. The boom of the backhoe is pivotally pinned by its first end to the bottom end of the swing tower thereby allowing the second or upper end of the boom to swing in a vertical arc. A pair of outboard mounted boom cylinders attach to and flank the boom and at their base ends pivotally connect to the upper end of the swing tower. Extension and retraction of the boom cylinder pistons serve arcuately to position the boom in the vertical plane. A second pair of hydraulically actuated cylinders mounted between the tractor mounting brackets and the swing tower control side to side movement of the backhoe assembly.

The transport position of the backhoe is characterized by raising the boom to a generally vertical orientation and carrying the dipper folded in as close as possible to the boom. This brings the center of gravity in close to the rear of the tractor to provide transport stability. However, the center of gravity in many prior art implementations was still sufficiently far to the rear of the tractor mounting point that handling was somewhat unstable. Long et al solved the transport position problem by configuring the swing tower, the boom and the outboard mounted cylinders so that the boom could swing towarad the tractor and downwaradly somewhat beyond the vertical. This brought the center of gravity of the raised boom assembly together with the dipper arm and bucket combination closer to the rear of the tractor, thus alleviating transport handling problems.

In the U.S. Pat. No. 4,074,821 to Long, a backhoe is disclosed wherein the boom consists of transversely spaced apart sections. This makes it possible to use a single boom cylinder which is mounted between the spaced apart boom sections. Overcenter forward movement of the boom is provided, making a stable transport configuration.

In both of the above citations, the inventors have has to make tradeoffs. In all cases, the total swing of the boom has to be something less than 180 degrees. Thus, if the boom is configured to swing in excess of 90 degrees above the horizontal, then it cannot depress down into the ground more than about 60–70 degrees. As a result the depth of the hole that can be dug is limited. Using my invention, the boom can be moved up close to the back of the tractor during transport and at the same time, the boom can swing downward into the ground beyond that angle possible with the prior art machines.

SUMMARY OF THE INVENTION

In accordance with the present invention, a backhoe arrangement is disclosed wherein the center of gravity for the transport mode is close to the rear of the tractor. In the transport position, the boom is slightly forward beyond vertical and toward the back of the tractor. A releasable locking mechanism holds the boom in a stored position so that no swinging motion or motion in azimuth is allowed.

In my implementation, upper and lower mounting brackets extend rearwardly from the tractor. A swing tower is pivotally mounted to the brackets. The swing tower is angularly positioned about the vertical by swing cylinder assemblies of conventional type suitably linked to the tower at diametrically opposed points on its periphery. To the rear of the swing tower I attach a cradle which opens rearward. The cradle is pivotally pinned near its center or tilt point to flanges extending from the tower assembly. The boom of the backhoe pivotally mounts at a lower pivot point of the cradle. A single boom cylinder is pivotally secured at its base to the cradle at the upper pivot point. The piston of this boom cylinder is secured pivotally to a bracket attached approximately two thirds the way out along the inboard side of the boom. The pistong of this boom cylinder is secured pivotally tower permit limited rotation of the cradle in the vertical plane of approximately 30 degrees. In use, the cradle is locked in either the sloping or the approximatelly vertical position. The sloping position is used for transporting the backhoe to or from the worksite. The vertical position is used when digging and loading earth at the worksite.

The provision of a two position cradle on which to mount the boom and the boom cylinder permits utilization of only one boom cylinder to accomplish over-vertical positioning during the transport phase. At the same time visibility is enhanced for the digging and loading phase since a narrow overall boom and cylinder width combination is achieved.

Moving the cradle from the transport to the working position and vice versa is readily accomplished. The boom is lowered until the bucket rests on the ground. The using the hydraulic control lever which activated the boom cylinder, retraction of the piston shifts the cradle to the working position and extension of the piston shifts the cradle to the transport position. Once the desired status is achieved, the cradle can be stoppered for use in that position.

BRIEF DESCRIPTION OF THE DRAWINGS

In the accompanying drawings, like numerals are employed to designate like parts throughout.

DESCRIPTION OF THE PREFERRED EMBODIMENT

Figure 1:
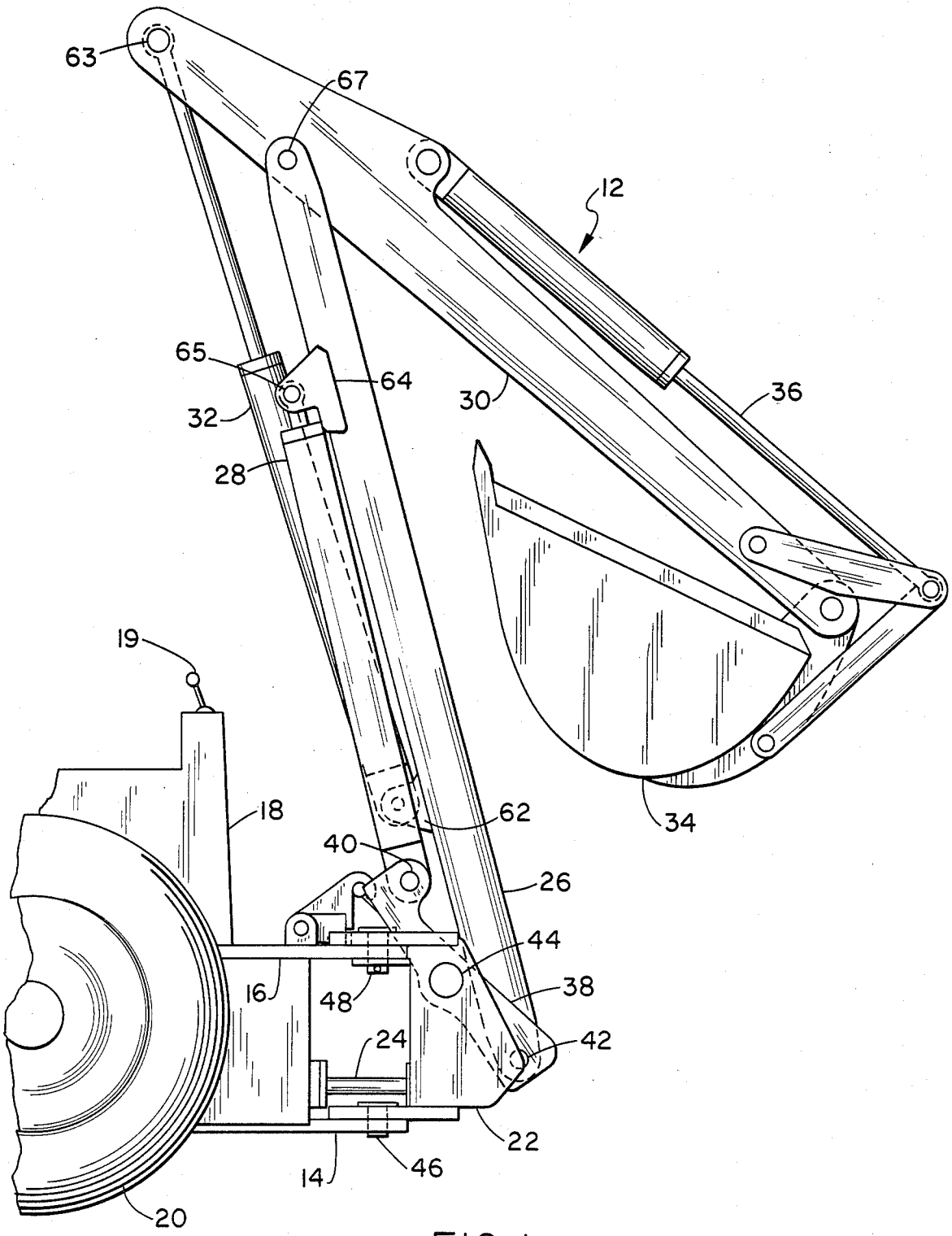
FIG. 1 is a side elevational view representing the parts in a position corresponding to the normal transport configuration.
Figure 9:
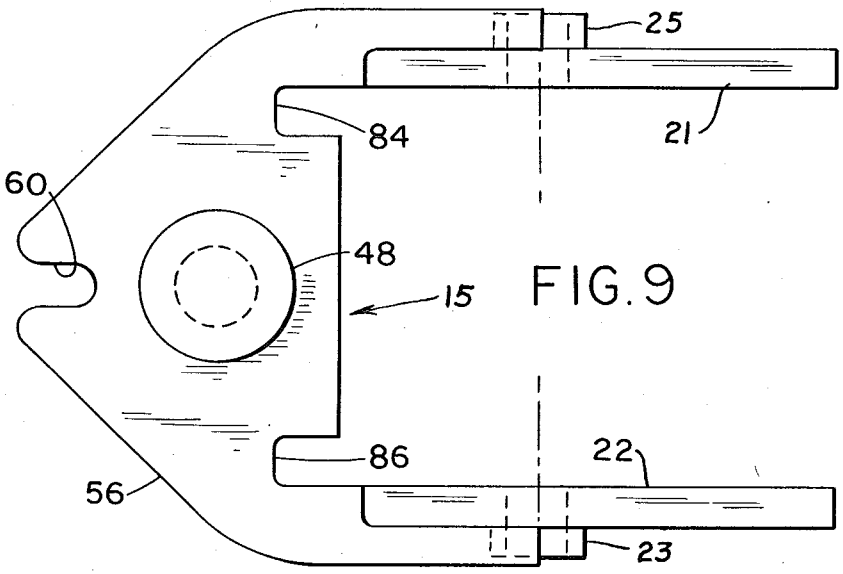
FIG. 9 is a top view of the swing tower.

Referring to FIG. 1 there is shown a backhoe assembly 12 which is attached to the rear of a tractor 18 supported by wheels 20. Upper and lower mounting brackets 16 and 14 extend rearward from tractor 18. These brackets pivotally support swing tower 15 allowing it to move around the vertical axis provided by pivot pins 46 and 48 and in the horizontal plane (i.e. in azimuth). Swinging movement of the swing tower is produced in conventional fashion by a pair of fluid actuated swing cylinders 24 anchored to the tractor at their base ends and pivotally mounted at their piston ends to diametrically opposed points (not shown) on the periphery of the swing tower. A rear facing generally u-shaped cradle 38 is nested within the sidewalls 21, 22 (FIG. 9) of the swing tower. The swing tower, with its sidewalls, is the support means for the cradle 38. Cradle 38 is pivotally secured at its tilting point by pin 44 (FIGS. 1, 2, 3) to flanges 23, 25 (FIG. 9) projecting from said sidewalls 21, 22.

The lower end of boom 26 is hinged to the bottom end of cradle 38 by pin 42 at the lower pivot point of cradle 38. The top end of cradle 38 is hinged to boom cylinder 28 by pin 40. The boom cylinder is an actuating means. It is also referred to herein as a first control cylinder. The opposite or piston end of boom cylinder 28 is connected by a pivot pin 65 to bracket 64 which is secured as by welding to boom 26 in the upper region thereof i.e., in the region near the free end. A dipper arm 30 attaches by pin 67 to the extreme upper end of boom 26. At the other extremity of dipper arm 30 there is pivotably mounted a bucket 34 of conventional design. Hydraulic dipper cylinder 32 attached between boom bracket 62 and pin 63 at the inboard end of dipper arm 30 controls the extension and retraction of the dipper arm. Dipper cylinder 32 is an actuating means. It is also referred to as a second control cylinder. Bucket action is controlled by a hydraulic cylinder 36 suitably linked to the bucket and dipper arm in conventional fashion.

Figure 3:
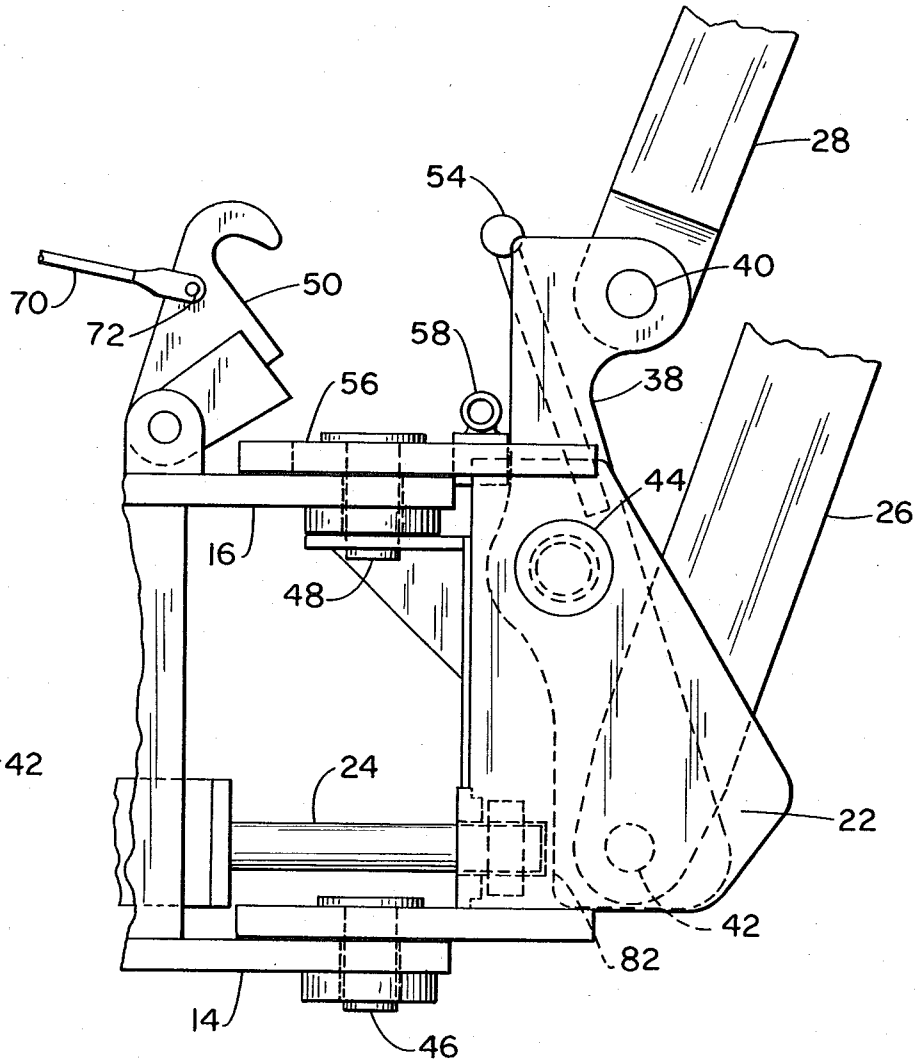
FIG. 3 is a side elevational view of the swing tower mount showing the cradle in the working position.
Figure 2:
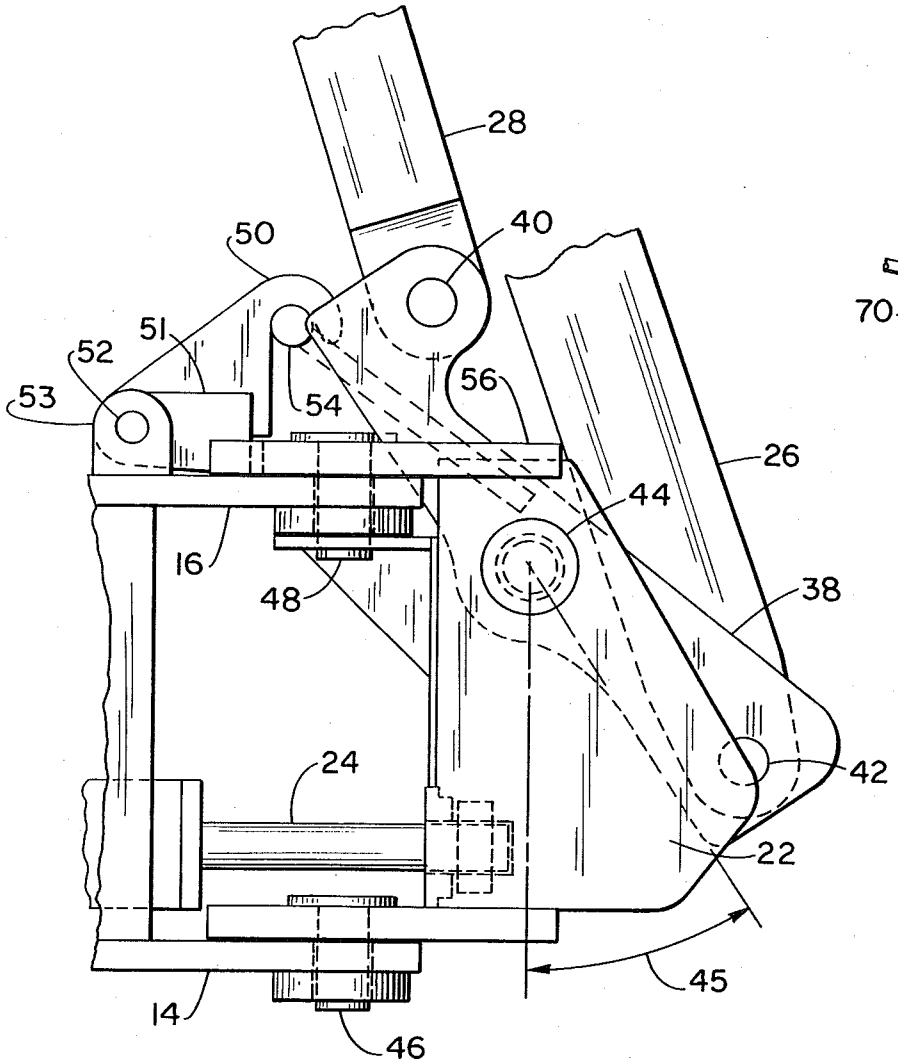
FIG. 2 is a side elevational view of the swing tower mount showing the cradle in the transport position.

In use, cradle 38 is fixedlly stopped in the sloping position shown in FIG. 2 or the generally vertical position shown in FIG. 3. As shown by arc 45 of FIG. 2, the angular displacement between the transport and working positions of the cradle is approximately 30 degrees. When latched in the transport position shown in FIGS. 1 and 2, with the cradle tilted the boom depicted (See FIG. 1) thus producing stability during transport. When the cradle is locked in the generally vertical position as shown in FIG. 3 the boom can be depressed downward into the ground until it is at an angle greater than 80 degrees below the horizontal.

Figure 4:
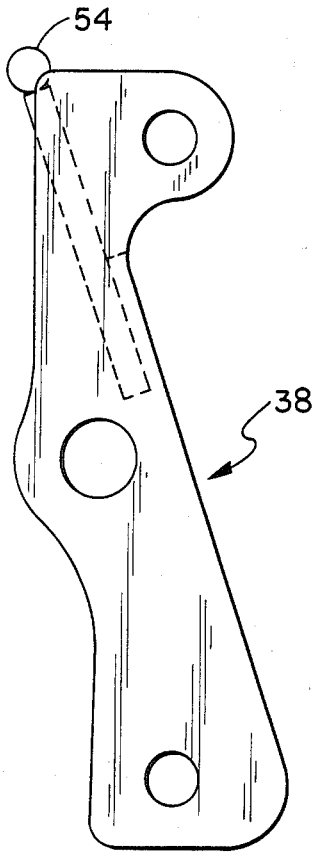
FIG. 4 is a side view of the cradle.
Figure 5:
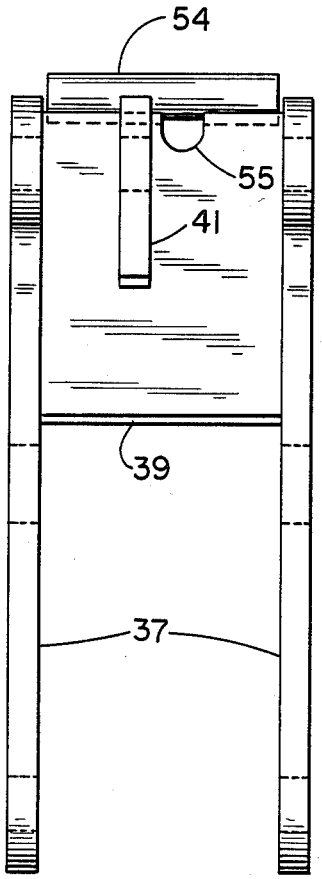
FIG. 5 is a face-on view of the cradle as viewed from the rear of the tractor.

Referring now to FIGS. 2–5 and 7–10, the cradle 38 is shown as being copmrised of sidewalls 37, backwall 39, and integral tab 41 terminating in latching bar 54 (See FIGS. 4 and 5). With the cradle 38 positioned in the sloping orientation shown in FIG. 2, a latch mechanism 50 on the top of mounting bracket 16 secures the cradle by engagement with the latching bar 54. As shown in FIG. 5, the hook-like catch at the end of the latch mechanism 50 nests in pocket 55 formed in backwall 39.

Figure 10:
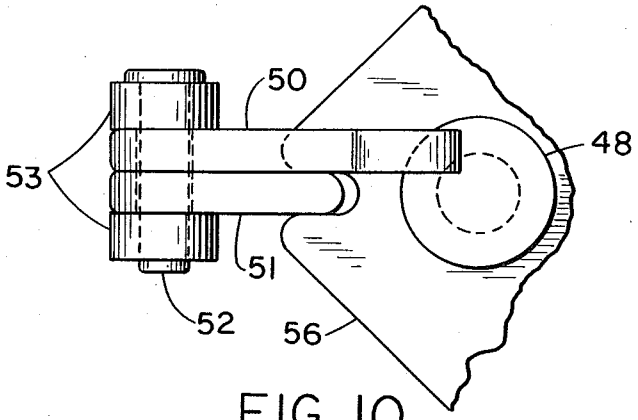
FIG. 10 is a top view of the keeper which both locks the cradle into the transport position and secures the swing tower against rotation and in a neutral orientation for transport.

Latch mechanism 50 additionally locks swing tower 15 into a neutral orientation so that it cannon turn left and right in azimuth during the transport phase. Locking of the swing tower during transport of the backhoe is accomplished by stop 51 (See FIG. 2) dropping into notch 60 of top member 56 which forms a part of swing tower 15 (See FIGS. 3 and 9). Slots 84 and 86 in top member 56 of the swing tower (See FIG. 9) serve to nest and support the sidewalls 37 of cradle 38 in the transport mode. A top view of latch mechanism 50 is shown in FIG. 10. Brackets 53, between which the latch of mechanism 50 is pivotally mounted, are secured as by welding to the tractor mount. Pivotally hinged by pin 52 is the integrally mounted latch member of mechanism 50 and stop 51.

Figure 11:
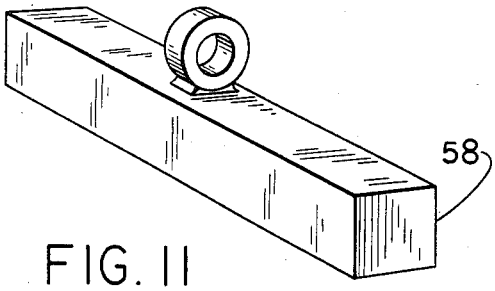
FIG. 11 is a perspective view of the block which locks the cradle in working position.

When the latch of latch mechanism 50 is disengaged from latching bar 54 as shown in FIG. 3, cradle 38 can be rotated to the vertical position by the swinging of the boom to an outboard and depressed position. Disengagement of the catch 50 can be accomplished by use of a cable 70 which is pivotally attached to the catch by pin 72 (See FIG. 3). When the cradle is rotated to the vertical position it will bottom out against the swing tower at point 82 (See FIG. 3). As a result there will be an open space between top member 56 and the back faces of the cradle side pieces 37. Stop block 58 (See FIG. 11) will, when positioned as shown in FIG. 3, lock the cradle in the working position. In the unit reduced to practice, stop bar 58 was manually inserted to secure the cradle in the working position. It is to be understood that a hydraulically or electromagnetically actuated thrust pin or pins securing the sidewalls of the tower to side pieces 37 of the cradle at a location between pins 42 and 44 (See FIG. 3) would accomplish the same result.

Figure 8:
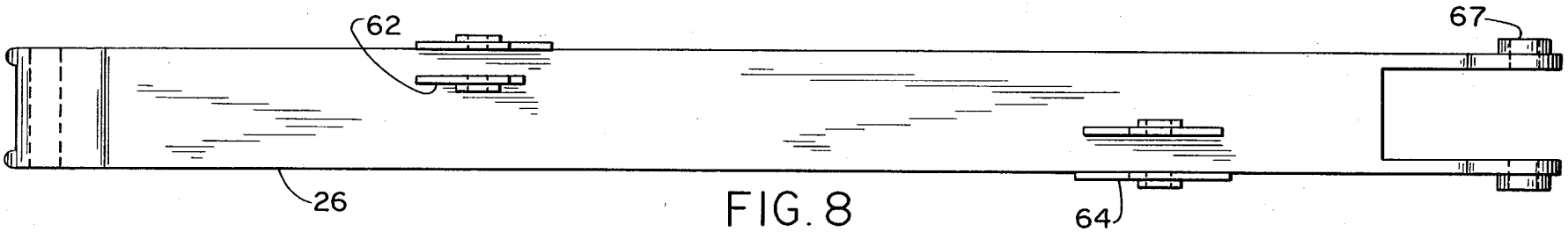
FIG. 8 is a top view of the boom.
Figure 7:
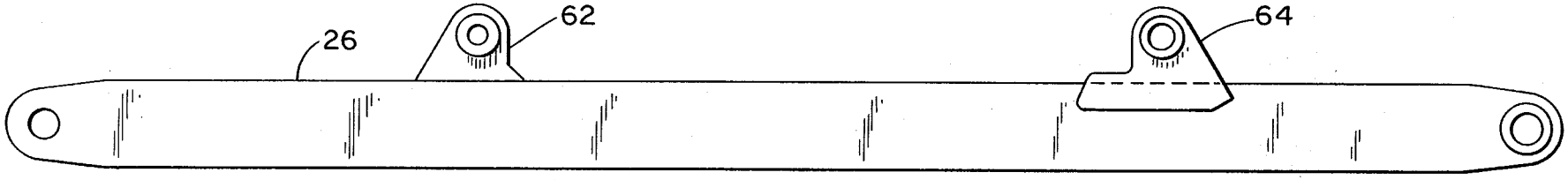
FIG. 7 is a side view of the boom showing on the right the bracket to which the piston end of the boom cylinder attaches and on the left the bracket to which the cylinder end of the dipper actuator connects.

FIGS. 7 and 8 show the manner in which boom 26 was implemented. Box beam construction was utilized thus providing strength at reasonable cross sectional size. Implementation is arranged such that the boom sylinder 28 and the dipper cylinder 32 operate alongside. Only one boom cylinder is required. The base end of the boom cylinder attaches by hinge pin 40 to the upper end of the cradle and the second or piston end of the cylinder attaches to bracket 64, secured to the boom in its upper region. The base end of the dipper cylinder attaches to bracket 62 and extends upward to its pivotal attachment point at the inboard end of the dipper arm. As shown in FIG. 8, at 67 the dipper assembly rests in a notch at the upper end of the boom.

Figure 6:
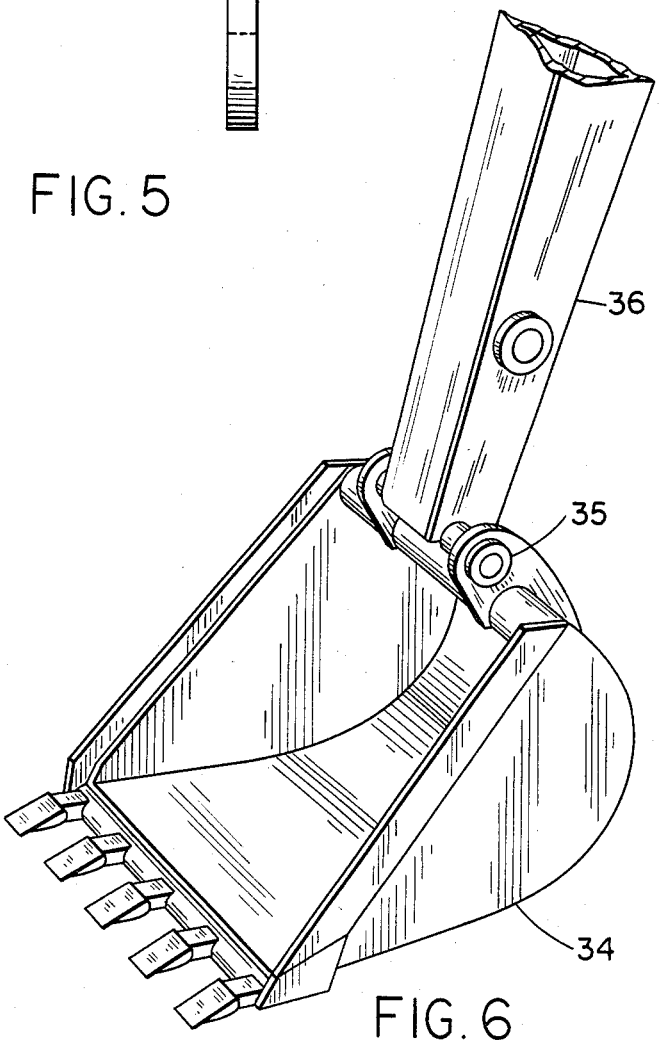
FIG. 6 is a perspective view of the backhoe bucket.

FIG. 6 shows a perspective view of dipper 36 and bucket 34 which is attached at the far end of the dipper by pin 35. On advantage of the backhoe implemented to include my invention is that it allows a narrow bucket to be used. This comes about due to the fact that both boom cylinder 28 and dipper cylinder 32 rest in parallel atop boom 26, not extending laterally substantially beyond the width of the boom, and thus do not obstruct the operator's view when digging a narrow trench.

Operator control of the backhoe is provided by means of a multiplicity of hydraulic control levers 19 (See FIG. 1). Although no hydraulic hoses are shown in FIG. 1 it is to be understood that an appropriate compliment of hoses provide connections to cylinders 24, 28, 32 and 36.

It is to be understood (See FIG. 2) that actuation of latch mechanism 50 which secures the cradle in the sloping position and locks the swing tower into a neutral position does not hold the boom, against additional inboard tilt in the over-vertical position. This provides an advantage over the prior art in that it allows the boom to be lowered beyond the FIG. 1 position shown in order to avoid overhead obstacles when transporting the machining from worksite to worksite.

My invention permits utilization of only one boom cylinder to achieve the over-vertical transport position, bringing the center of mass close to the rear of the tractor. Use of one large boom cylinder provides greater efficiency than does the use of the two outboard-situated boom cylinders of some prior art equipment. The relatively narrow structure provided by my invention improves visibility and reduces overall weight and vehicle length.

While there has been shown and described what is at present considered to be the preferred embodiment of the invention, it will be obvious to those skilled in the art that various changes and modification may be made therein without departing from the true scope of the invention as defined in the appended claims.

I claim:

1. In mobile machinery, the combination of
a boom having a free end and a lower end,
and earth-working mechanism hinged at the free end of said boom,
a cradle formed to provide upper and lower pivot points and a tilting point therebetween
support means adapted to provide a pivotal mounting for said cradle so that it can tilt about said tilting point,
said boom being hinged to said cradle at said lower pivot point, and
a first control cylinder having a base hinged to the cradle at the cradle at the upper pivot point and a piston pivotally secured to said boom in the region of its free end in order to swing said boom relative to the horizontal axis,
said cradle being tilted in a transport position as the boom and earth-working mechanism are swung over-vertical to an inboard position,
said cradle being tilted in a working position as the boom and cylinder are swung to an outboard and depressed position.

2. The combination in accordance with claim 1, in which the support means is formed as a swing tower, and means for adjusting the angular position of said tower about the vertical axis.

3. The combination in accordance with claim 2 in which the earth-working mechanism includes a dipper arm hinged to the free end of said boom and a second control cylinder having a base secured to said boom in the region of its lower end,
and a piston pivotally secured to the inboard of said arm to swing said earth-working mechanism.

4. The combination in accordance with claim 3 in which the earth-working mechanism further includes
a swingably mounted earth-moving bucket at the outboard end of said dipper arm and
means for controlling the working of said bucket, the mobile machinery being characterized as a backhoe.

5. The combination in accordance with claim 4 in which the first piston and the second cylinder are hinged to the boom at longitudinally spaced and laterally offset points.

6. The combination in accordance with claim 5 in which the width dimensions of the two cylinders, taken together, do not substantially exceed that of the boom.

7. The combination in accordance with claim 6, and means for locking said cradle in said transport position.

8. The combination in accordance with claim 6 and means for locking said cradle in said working position.

9. The combination in accordance with claim 8 and means for locking said cradle in said transport position.

10. In mobile machinery, the combination of
a boom having a free end,
an earth-working mechanism hinged at the free end of said boom,
a cradle formed to provide upper and lower pivot points and a tilting point therebetween,
support means adapted to provide a pivotal mounting for said cradle so that it can tilt about said tilting point,
said boom being hinged to said cradle at said lower pivot point, and
actuating means hinged between said boom and the upper pivot point of said cradle to swing said boom in elevation and depression,
said cradle being tilted in a transport position as the boom and earth-working mechanism are swung to an inboard position,
said cradle being tilted in a working position as the boom and cylinder are swung to an outboard and depressed position.

11. The combination in accordance with claim 10 in which the support means is formed as a swing tower, and means for adjusting the angular position of said tower about the vertical axis.

12. The combination in accordance with claim 11 in which the earth-working mechanism includes a dipper arm hinged to the free end of said boom and a second actuating means hinged between the lower region of said boom and the inboard end of said arm to swing said earth-working mechanism.

13. The combination in accordance with claim 12 in which the earth-working mechanism further includes a
swingably mounted earth-moving bucket at the outboard end of said dipper arm
and means for controlling the working of said bucket, the mobile machinery being characterized as a backhoe.

14. The combination in accordance with claim 12 and means for locking said cradle in said transport position.

15. The combination in accordance with claim 12 and means for locking said cradle in said working position.

16. In machinery, the combination of
a boom having a free end,
an earth working mechanism hinged at the free end of said boom,
a cradle formed to provide upper and lower points and a tilting point therebetween,
support means adapted to provide a pivotal mounting for said cradle so that it can tilt about said tilting point,
said boom being hinged to said cradle at said lower pivot point, and
actuating means between said boom and the upper pivot point of said cradle to swing said boom in elevation and depression.

* * * * *

UNITED STATES PATENT AND TRADEMARK OFFICE

CERTIFICATE OF CORRECTION

PATENT NO. : 4,720,234

DATED : January 19, 1988

INVENTOR(S) : Cecil J. Stralow

It is certified that error appears in the above-identified patent and that said Letters Patent is hereby corrected as shown below:

Column 1, line 38, cancel "towarad" and substitute --toward--.

line 38, cancel "downwaradly" and substitute --downwardly--.

line 50, cancel "has" and substitute --had--.

Column 2, line 18, cancel "The pistong of this boom cylinder is secured pivotally" and substitute--The cradle configuration and the flanges on the swing--.

line 22, cancel "approximatelly" and substitute -- approximately--.

UNITED STATES PATENT AND TRADEMARK OFFICE

CERTIFICATE OF CORRECTION

PATENT NO. : 4,720,234

DATED : January 19, 1988

INVENTOR(S) : Cecil J. Stralow

It is certified that error appears in the above-identified patent and that said Letters Patent is hereby corrected as shown below:

Column 2, line 36, cancel "The" and substitute --Then- -.

line 36, cancel "activated" and substitute -activates--.

line 58, cancel "bracket" and substitute -- brackets --.

Column 3,line 43, cancel "fixedlly" and substitute --fixedly--.

line 49, after "boom" and before "depicted" insert -- is able to swing inboard in excess of 90 degrees above the horizontal as --.

line 56, cancel "coprised" and substitute --comprised--.

UNITED STATES PATENT AND TRADEMARK OFFICE

CERTIFICATE OF CORRECTION

PATENT NO. : 4,720,234

DATED : January 19, 1988

INVENTOR(S) : Cecil J. Stralow

It is certified that error appears in the above-identified patent and that said Letters Patent is hereby corrected as shown below:

line 65, cancel "cannon" and substitute --cannot--.

Column 4, line 35, cancel "sylinder" and substitute --cylinder--.

line 47, cancel "On" and substitute --One--.

line 68, cancel "maching" and substitute --machine--.

Column 5, line 14, cancel "modification" and substitute --modifications---.

Signed and Sealed this

Sixteenth Day of July, 1991

*Attest:*

*Attesting Officer*

HARRY F. MANBECK, JR.

*Commissioner of Patents and Trademarks*